US006644091B2

(12) United States Patent
Huang et al.

(10) Patent No.: US 6,644,091 B2
(45) Date of Patent: Nov. 11, 2003

(54) LOWER DIE FOR A BENDING MACHINE

(75) Inventors: Fu-Shun Huang, Taipei (TW); Chun Lin Chang, Taipei (TW)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 106 days.

(21) Appl. No.: 09/746,408

(22) Filed: Dec. 20, 2000

(65) Prior Publication Data

US 2002/0073761 A1 Jun. 20, 2002

(30) Foreign Application Priority Data

Dec. 15, 2000 (TW) ..... 089221826

(51) Int. Cl.[7] ..... B21D 37/04; B21J 9/02

(52) U.S. Cl. ..... 72/482.93; 72/414; 72/389.3; 72/481.1; 72/481.9; 72/482.93

(58) Field of Search ..... 72/481.1, 481.6, 72/481.9, 482.1, 482.2, 482.6, 482.91, 482.92, 482.93, 389.3, 389.6, 414

(56) References Cited

U.S. PATENT DOCUMENTS

| | | | | | |
|---|---|---|---|---|---|
| 3,209,576 | A | * | 10/1965 | Giordano | 72/389.3 |
| 3,668,919 | A | * | 6/1972 | Hongo | 72/389.3 |
| 3,681,994 | A | * | 8/1972 | Zbornik | 72/389.3 |
| 3,884,061 | A | * | 5/1975 | Westby | 72/389.3 |
| 5,245,854 | A | * | 9/1993 | Bruggink et al. | 72/481 |
| 5,829,288 | A | * | 11/1998 | Serruys | 72/389.6 |

FOREIGN PATENT DOCUMENTS

| | | | | |
|---|---|---|---|---|
| CA | 603653 | * | 8/1960 | 72/389.3 |
| JP | 355077931 | * | 6/1980 | 72/389.3 |
| JP | 403264118 | * | 11/1991 | 72/384 |

OTHER PUBLICATIONS

Cincinnati Shaper Company, "Cincinnati Mechanical Press Brakes", Dec. 28, 1959, pp. 1, 20, 21, 23, 32, 33, 36, and 37.*

Press Brake Dies, Inc., "Press Brake Die Manual", 1974 pp. 1–16.*

* cited by examiner

*Primary Examiner*—David Jones
(74) *Attorney, Agent, or Firm*—Wei Te Chung

(57) ABSTRACT

A lower die (10) for a bending machine includes a support member (40) and a work member (60), manufactured separately. The support member defines a longitudinal groove (44) in an upper surface thereof, a pair of longitudinal V-shaped slots (48) in opposite side walls thereof, and a plurality of screw holes (42) in a bottom surface thereof. A pair of shoulders (46) is formed on opposite sides of the groove. The work member comprises a position portion (66) for being accommodated in the groove, a pair of projections (68, 70) for abutting against the shoulders, and an upper wedge-shaped groove (72) for shaping a workpiece. The lower die is secured on a die shoe (20 or 20') by screws (12) which extend through the die shoe and engage with the screw holes, or by engagement of the V-shaped slots with V-shaped protrusions (29') of the die shoe (20').

4 Claims, 5 Drawing Sheets

LOWER DIE FOR A BENDING MACHINE

BACKGROUND OF THE INVENTION

1. Field of the Invention

The present invention relates to a lower die, and particularly to a lower die for a bending machine.

2. Related Art

A conventional lower die of a bending machine consists of a single member. The lower die is secured on a die shoe. The lower die respectively defines a pair of longitudinal V-shaped slots in a lower portion of opposite side walls thereof. The die shoe has a pair of longitudinal V-shaped projections, corresponding to the grooves of the lower die. The lower die is secured on the die shoe by engagement of the V-shaped grooves with the V-shaped projections.

The lower die may also be fastened on the die shoe by screws. Screw holes are defined in a bottom surface of the lower die. The die shoe defines through holes corresponding to the screw holes of the lower die. The lower die is fastened on the die shoe by screws which extend through the through holes of the die shoe to engage with the screw holes of the lower die.

Each such conventional kind of lower die can only be used for a given particular bending machine. When a different bending machine is required, the entire lower die must be exchanged for another one. Replacement of the entire lower die is unduly costly. Furthermore, since the lower die is fastened on the die shoe directly, the process of exchanging entire lower dies is complicated.

It is strongly desired to provide a lower die for a bending machine which overcomes the above problems encountered in the prior art.

SUMMARY OF THE INVENTION

Accordingly, an object of the present invention is to provide a lower die for a bending machine which facilitates exchange of the lower die for another one.

Another object of the present invention is to provide a lower die which fits various die shoes of a bending machine.

To achieve the above-mentioned objects, a lower die for a bending machine in accordance with the present invention comprises a support member and a work member, manufactured separately. The support member defines a longitudinal groove in an upper surface thereof, a pair of longitudinal V-shaped slots in a lower portion of opposite side walls thereof, and a plurality of screw holes in a bottom surface thereof. A pair of upwardly extending shoulders is formed on opposite sides of the groove of the support member. The work member comprises a T-shaped position portion and a work portion. The position portion comprises a lower position block for being accommodated in the groove of the support member, and a pair of projections for abutting against the shoulders of the support member. The work portion defines a wedge-shaped groove in an upper surface thereof, for shaping a workpiece. The lower die is secured on a die shoe by screws which extend through the die shoe to engage with the screw holes of the lower die. Further or alternatively, the lower die is secured on a die shoe by engagement of the V-shaped slots of the lower die with V-shaped protrusions of the die shoe.

Other objects, advantages and novel features of the present invention will be drawn from the following detailed description of preferred embodiments of the present invention with reference to the attached drawings, in which:

DESCRIPTION OF THE PREFERRED EMBODIMENTS

Figure 1:
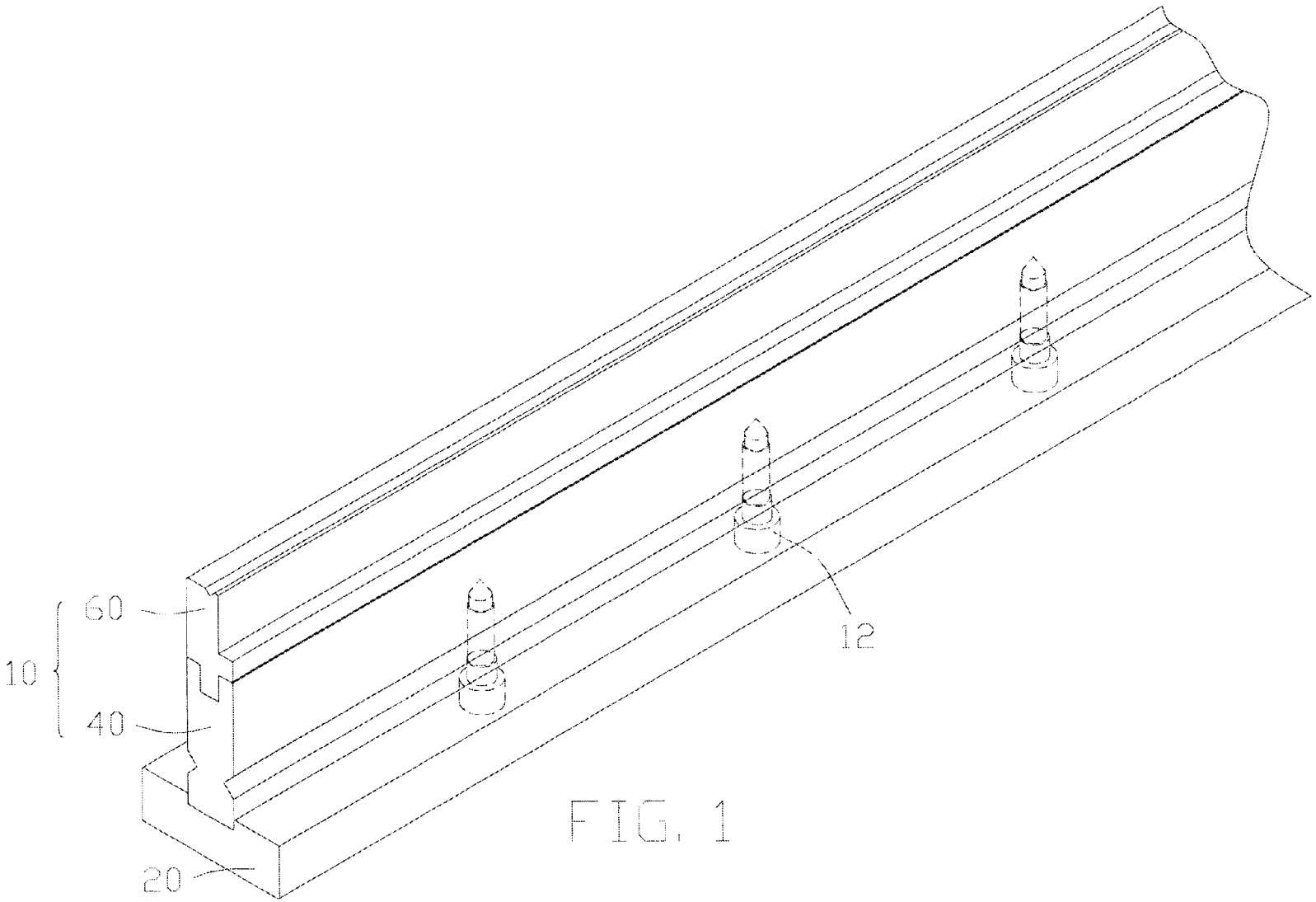
FIG. 1 is an assembled view of a lower die of the present invention and a die shoe.

Referring to FIG. 1, a lower die 10 for a bending machine (not shown) in accordance with the present invention is fastened on a die shoe 20 by screws 12. The lower die 10 comprises a support member 40 and a work member 60, manufactured separately.

Figure 2:
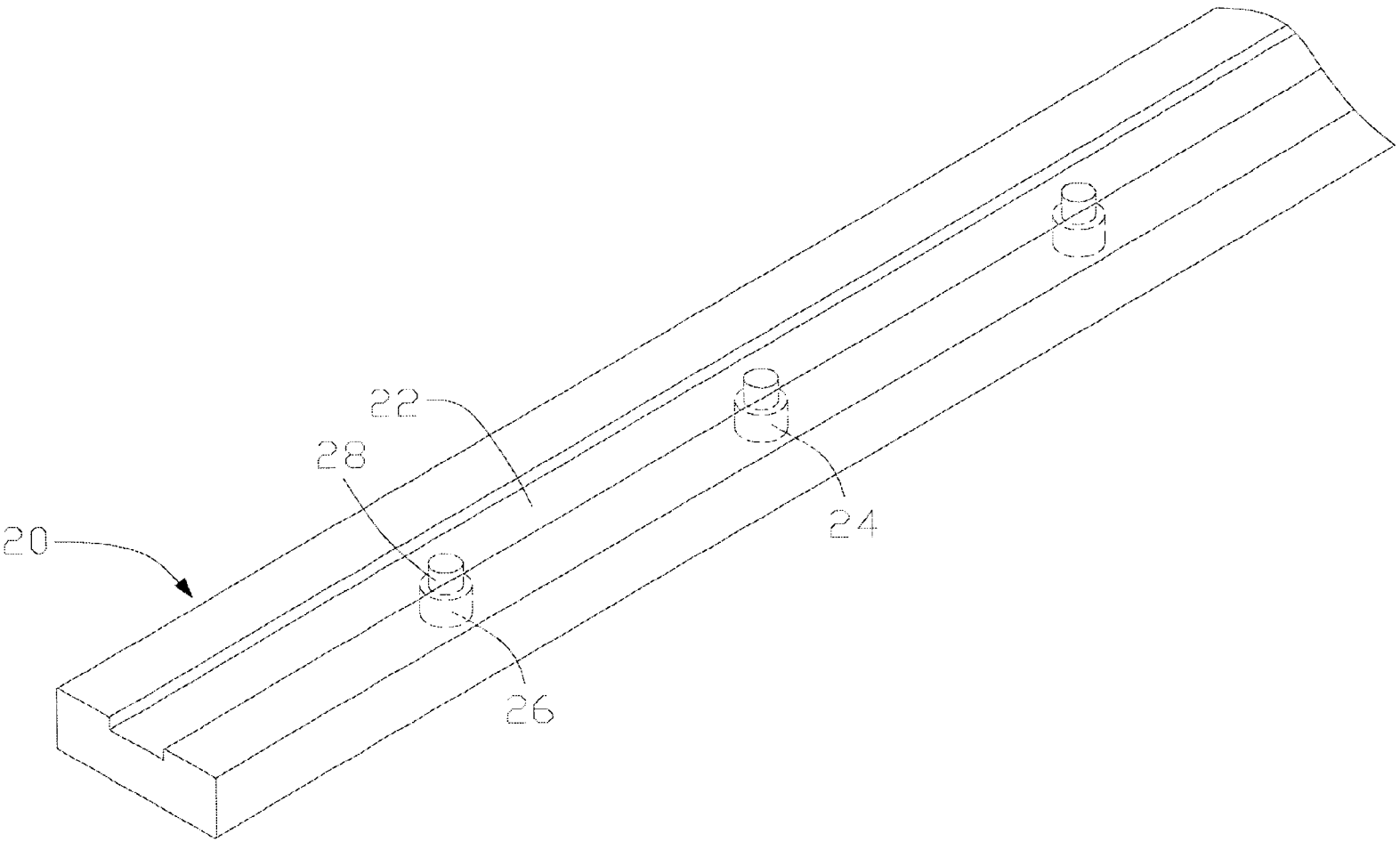
FIG. 2 is a perspective view of the die shoe of FIG. 1.

Referring also to FIG. 2, the die shoe 20 is integrally formed and generally slab-shaped. A longitudinal channel 22 is defined in a center of an upper surface of the die shoe 20. A plurality of longitudinally spaced through holes 24 is defined in a lower surface of the die shoe 20, in communication with the channel 22. Each through hole 24 comprises a lower receiving portion 26 for receiving a head of the corresponding screw 12, and an upper guiding portion 28 in communication with the receiving portion 26.

Figure 3:
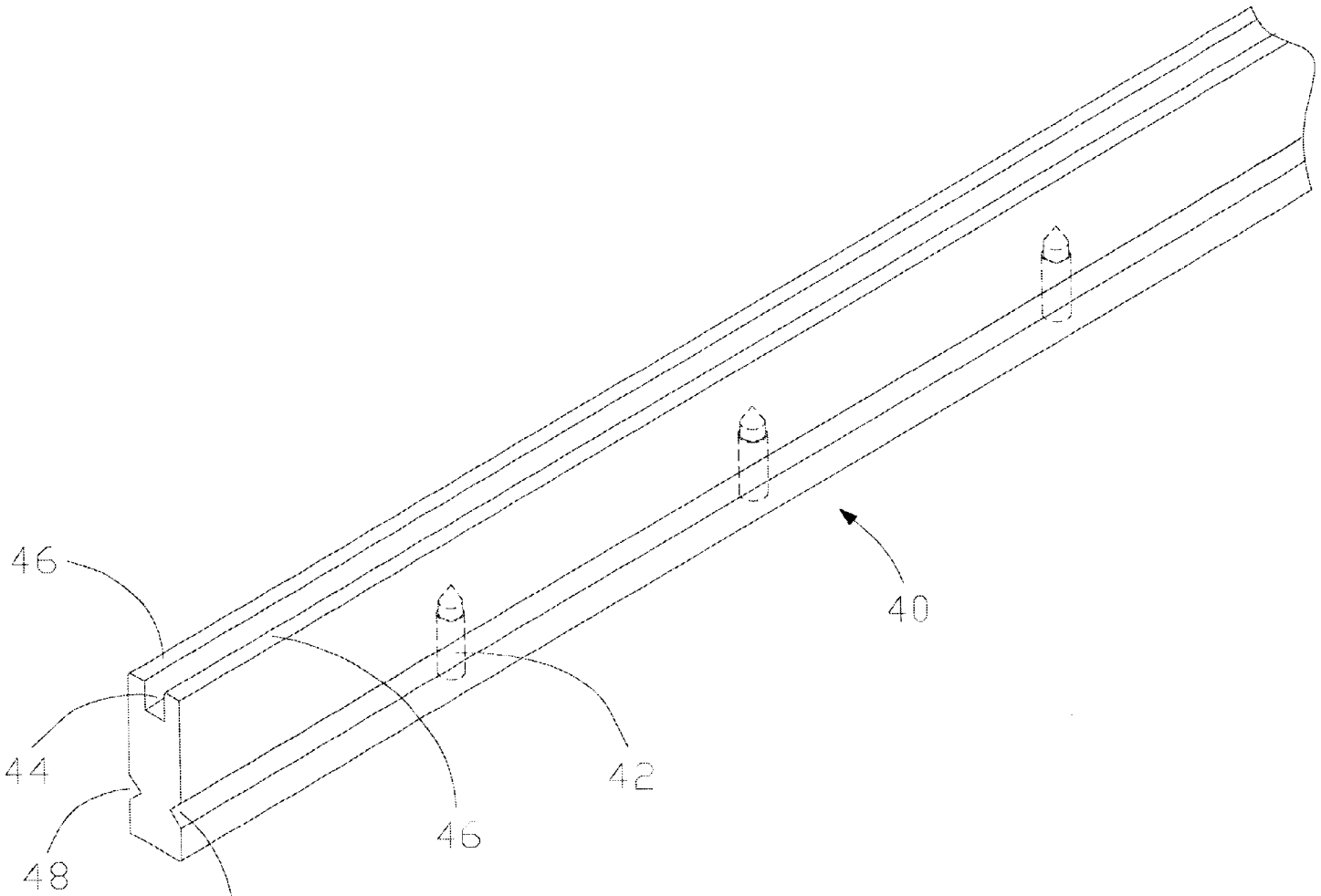
FIG. 3 is a perspective view of a support member of the lower die of FIG. 1.

Referring also to FIG. 3, a plurality of threaded screws holes 42 is defined in a lower surface of the support member 40, corresponding to the through holes 24 of the die shoe 20. The support member 40 defines a longitudinal groove 44 in a center of an upper surface thereof, thus forming a pair of upwardly extending shoulders 46 on opposite sides of the groove 44. A pair of symmetrical V-shaped slots 48 is respective defined in a lower portion of opposite side walls of the support member 40, parallel to the groove 44.

Figure 4:
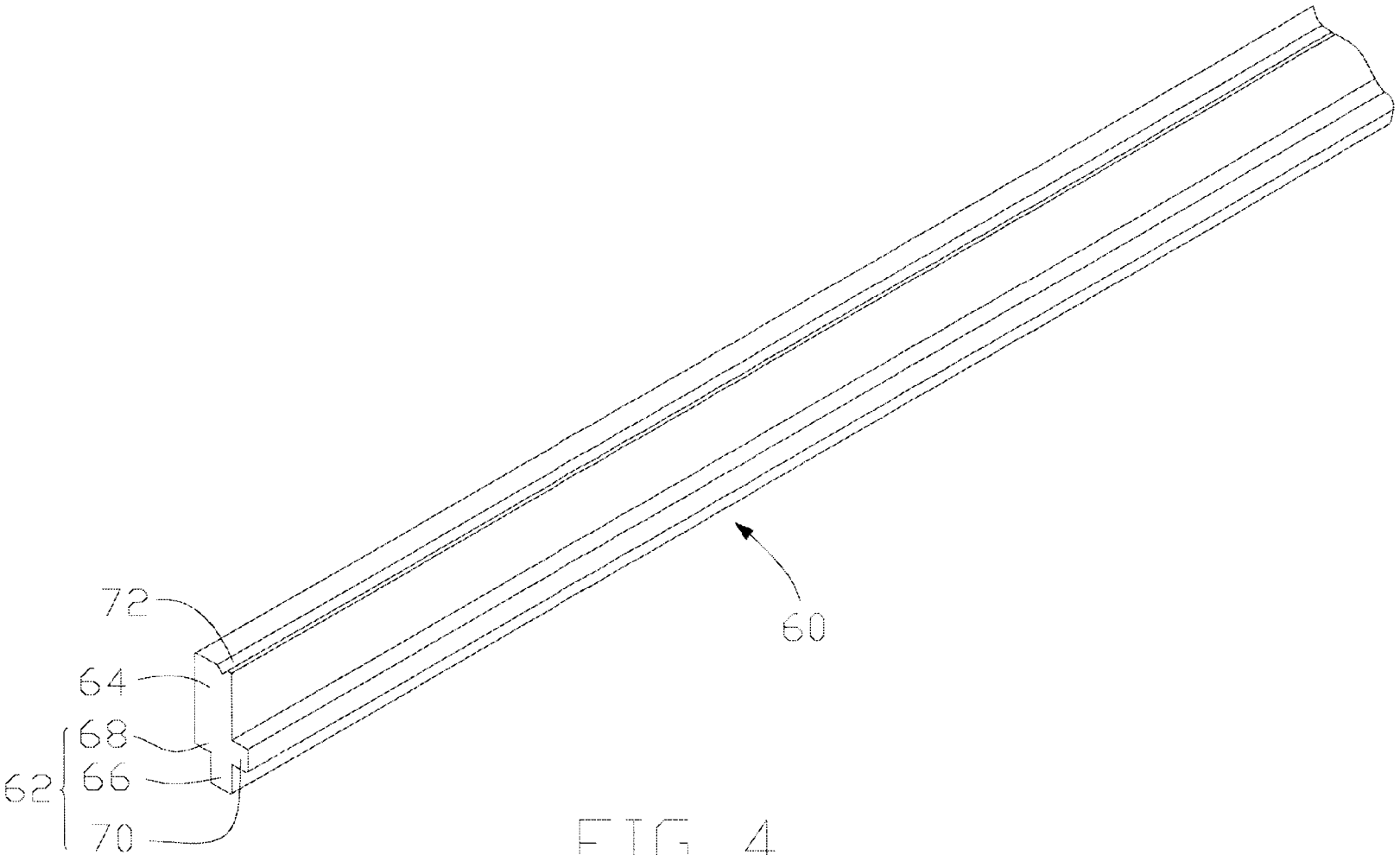
FIG. 4 is a perspective view of a work member of the lower die of FIG. 1.

Referring also to FIG. 4, the work member 60 comprises a T-shaped position portion 62 and a work portion 64. The position portion 62 comprises a lower position block 66 corresponding to the groove 44 of the support member 40. A pair of first and second longitudinal projections 68, 70 respectively extends outwardly from opposite sides of an upper portion of the position block 66. The work portion 64 extends perpendicularly upwardly from the first projection 68 and offset from the second projection 70. A wedge-shaped groove 72 is defined in an upper surface of the work portion 64, for shaping a workpiece (not shown) in operation. The shape of the groove 72 depends on the specifications of the workpiece (not shown).

Referring to FIGS. 1–4, in assembly, the support member 40 of the lower die 10 is placed on the die shoe 20. A lower portion of the support member 40 is received in the channel 22 of the die shoe 20. The screws 12 are extended through the through holes 24 of the die shoe 20 to threadedly engage with the screws holes 42 of the support member 40. The work member 60 of the lower die 10 is then placed on the support member 40. The position block 66 of the work member 60 is accommodated in the groove 44 of the support member 40, and the first and second projections 68, 70 respectively abut against the shoulders 46 of the support member 40. Thus the lower die 10 is secured on the die shoe 20.

Figure 5:
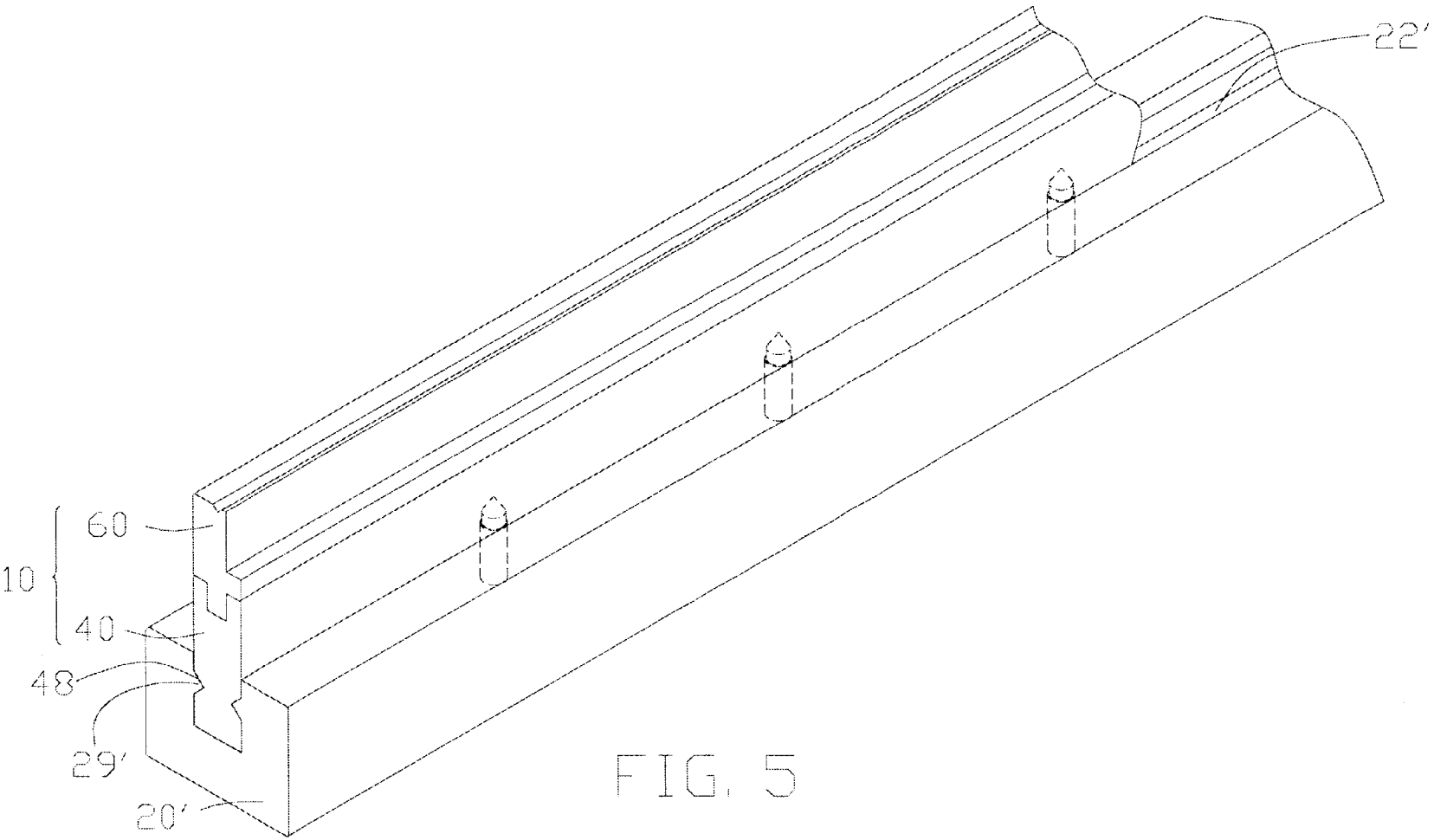
FIG. 5 is similar to FIG. 1, but showing the lower die of the present invention attached to another kind of die shoe.

FIG. 5 shows an alternative embodiment of the present invention wherein the lower die 10 is attached to another kind of die shoe 20'. The die shoe 20' defines a longitudinal channel 22' in a center of an upper surface thereof. A pair of symmetrical V-shaped protrusions 29' is formed on opposite internal side walls (not labeled) of the die shoe 20' adjacent the channel 22'. In assembly, the support member 40 of the lower die 10 is attached on the die shoe 20', with the slots 48 of the support member 40 engaging with the protrusions 29' of the die shoe 20'. The work member 60 of the lower die 10 is then mounted on the support member 40.

In the present invention, the lower die 10 consists of the support member 40 and the work member 60. When a different product or workpiece is required, the entire lower die 10 need not be replaced. Only the work member 60 of the lower die 10 needs to be exchanged for another work member. Similarly, when a lower die of different height is required, the entire lower die 10 need not be replaced. Only the work member 60 or the support member 40 of the lower die 10 needs to be exchanged for another work member or support member. All this facilitates changeover of the lower die, and reduces manufacturing costs. Furthermore, the lower die 10 fits not only the die shoe 20 having the shoulder holes 24, but also the die shoe 20' having the V-shaped protrusions 29'.

It is understood that the invention may be embodied in other forms without departing from the spirit thereof. Thus, the present examples and embodiments are to be considered in all respects as illustrative and not restrictive, and the invention is not to be limited to the details given herein.

What is claimed is:

1. A lower die of a bending machine comprising:

a support member having a groove and a pair of shoulders on opposite sides of the groove; and a work member comprising a position portion accommodated in the groove of the support member, and a work portion adapted for shaping a workpiece, the position portion comprising a lower position block accommodated in the groove and a pair of first and second longitudinal projections respectively abutting against the shoulders of the support member, the work portion extending upwardly from the first projection and offset from the second projection.

2. The lower die as claimed in claim 1, wherein the work portion defines a wedge-shaped groove for shaping the workpiece.

3. A lower die assembly comprising:

a single integrally formed die shoe defining a channel in an upper surface thereof; and a lower die secured on the channel, the lower die comprising a support member and a work member manufactured separately wherein the support member comprises a groove and a pair of shoulders on opposite sides of the groove, and the work member comprises a position block for being accommodated in the groove to thereby secure the work member on the support member and a pair of projections for abutting against the shoulders, and wherein the work member further comprises a work portion extending upwardly from a first one of the pair of projections and offset from a second one of the pair of projections.

4. A lower die assembly comprising:

a die shoe defining a channel; and a lower die secured on the channel, the lower die comprising a support member and a work member manufactured separately, wherein the die shoe forms a pair of V-shaped protrusions, and the lower die defines a pair of V-shaped slots for engaging with the protrusions.

* * * * *